US011179934B2

(12) United States Patent
Oya et al.

(10) Patent No.: US 11,179,934 B2
(45) Date of Patent: Nov. 23, 2021

(54) LIQUID EJECTION HEAD AND METHOD OF MANUFACTURING THE SAME

(71) Applicant: CANON KABUSHIKI KAISHA, Tokyo (JP)

(72) Inventors: Shuhei Oya, Kawasaki (JP); Makoto Watanabe, Yokohama (JP); Takanobu Manabe, Oita (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/787,904

(22) Filed: Feb. 11, 2020

(65) Prior Publication Data

US 2020/0254757 A1 Aug. 13, 2020

(30) Foreign Application Priority Data

Feb. 13, 2019 (JP) ..... JP2019-023546

(51) Int. Cl.
*B41J 2/14* (2006.01)
*B41J 2/16* (2006.01)

(52) U.S. Cl.
CPC ..... *B41J 2/14145* (2013.01); *B41J 2/14* (2013.01); *B41J 2/1404* (2013.01); *B41J 2/1603* (2013.01); *B41J 2/1623* (2013.01); *B41J 2002/14475* (2013.01); *B41J 2202/11* (2013.01); *B41J 2202/22* (2013.01)

(58) Field of Classification Search
CPC ..... B41J 2/14145; B41J 2/1404; B41J 2/14; B41J 2202/11; B41J 2002/14475; B41J 2/1623; B41J 2202/22
See application file for complete search history.

(56) References Cited

U.S. PATENT DOCUMENTS

| | | | | |
|---|---|---|---|---|
| 7,628,469 | B2 | 12/2009 | Inoue | |
| 8,733,902 | B2 * | 5/2014 | Chung | B41J 2/1753 347/65 |
| 9,162,459 | B2 | 10/2015 | Nagai et al. | |
| 2018/0326723 | A1 | 11/2018 | Manabe et al. | |
| 2020/0079083 | A1 | 3/2020 | Hashimoto et al. | |
| 2020/0079084 | A1 | 3/2020 | Ibe et al. | |

FOREIGN PATENT DOCUMENTS

| | | | |
|---|---|---|---|
| JP | 2007-283501 | A | 11/2007 |

* cited by examiner

*Primary Examiner* — Geoffrey S Mruk
(74) *Attorney, Agent, or Firm* — Venable LLP

(57) ABSTRACT

A liquid ejection head includes a substrate provided with an energy-generating element, an ejection orifice forming member that is formed on the substrate and includes an ejection orifice from which liquid is ejected, a reinforcing rib provided in the ejection orifice forming member, and a recess that is formed in the substrate and forms a part of a flow path of liquid, wherein the reinforcing rib is disposed in the inside of the recess.

16 Claims, 4 Drawing Sheets

LIQUID EJECTION HEAD AND METHOD OF MANUFACTURING THE SAME

BACKGROUND OF THE INVENTION

Field of the Invention

The present invention relates to a liquid ejection head that ejects liquid and to a method of manufacturing the same.

Description of the Related Art

Kinds of liquid ejection heads that eject liquid from ejection orifices include an inkjet recording head that performs recording by ejecting liquid ink onto a recording medium such as paper. As such inkjet recording head, there is one that includes an element substrate in which at least an ejection orifice, an individual flow path communicating with the ejection orifice, a common liquid chamber and a supply path that supply liquid to the individual flow path, and an energy-generating element that generates energy for ejection of liquid, are provided. The element substrate includes a substrate made of silicon and is provided with a supply path passing through the substrate along a thickness direction. The ejection orifice, the individual flow path, and the common liquid chamber in which liquid flows or is stored are formed of recesses formed in the substrate or an ejection orifice forming member, and thus, the substrate and the ejection orifice forming member are likely to have configurations vulnerable to external force.

Japanese Patent Application Laid-Open No. 2007-283501 describes a configuration in which a beamlike protrusion and a reinforcing rib are formed on a surface of an ejection orifice forming member, the surface facing a substrate. In the configuration described in Japanese Patent Application Laid-Open No. 2007-283501, the reinforcing rib improves stiffness of the ejection orifice forming member and suppresses damages that are caused to the ejection orifice forming member by external force.

In recent years, for higher image quality and a higher speed in recording, the number of ejection orifices of a liquid ejection head has been on an increasing trend, and accordingly, an element substrate has been more and more increased in size. Due to such increase in size, an element substrate may probably be subjected to greater stress, and there is a demand for higher stiffness to prevent peeling-off or rupture of an ejection orifice forming member.

SUMMARY OF THE INVENTION

A liquid ejection head according to the present invention includes a substrate provided with an energy-generating element, an ejection orifice forming member that is stacked on the substrate and includes an ejection orifice from which liquid is ejected, a reinforcing rib provided in the ejection orifice forming member, and a recess that is formed in the substrate and forms a part of a flow path of the liquid, wherein the reinforcing rib is disposed in an inside of the recess.

Further features of the present invention will become apparent from the following description of exemplary embodiments with reference to the attached drawings.

DESCRIPTION OF THE EMBODIMENTS

In the configuration described in Japanese Patent Application Laid-Open No. 2007-283501, the reinforcing rib serves as a wall with respect to flow of liquid, which may block circulation of ink and affect ejecting characteristics in some cases. Thus, it is difficult to arrange a plurality of reinforcing ribs at a high density. Then, considering ejecting characteristics, a plurality of reinforcing ribs is arranged at relatively-long regular intervals along a direction in which energy-generating elements are arranged, and further, a columnar protrusion is arranged between adjacent ones of the reinforcing ribs. Meanwhile, as a reinforcing rib is bonded to a bonding surface of a substrate, application of shear stress greater than bonding strength between the reinforcing rib and the substrate may cause the reinforcing rib to peel off and be separated from the substrate, so that resistance to flow of liquid is changed, to cause faulty ejection and reduce a recording quality, in some cases.

In view of this, it is an object of the present invention to provide a liquid ejection head that can achieve excellent liquid ejection and can suppress damages to an element substrate, and a method of manufacturing the same.

Below, embodiments of the present invention will be described in detail with reference to the drawings.

[Basic Configuration of Liquid Ejection Head]

Figure 1:
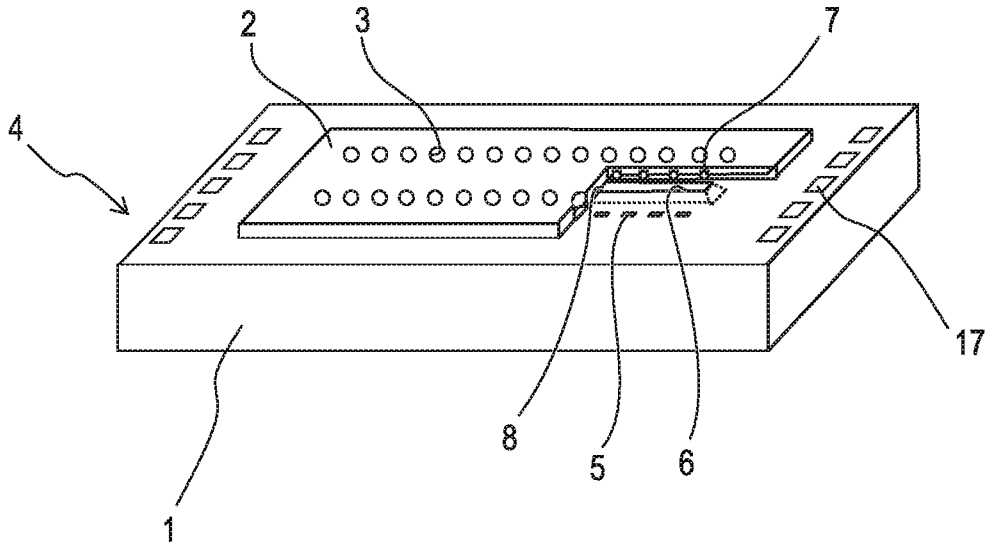
FIG. 1 is a perspective view of a liquid ejection head according to the present invention.

FIG. 1 is a perspective view of a liquid ejection head 4 according to the present invention. In FIG. 1, for the purpose of clarifying an internal structure, a part of an ejection orifice forming member 2 is omitted. The liquid ejection head 4 according to the present invention includes an element substrate that includes a substrate 1 provided with an energy-generating element 5, and the ejection orifice forming member 2 formed on the substrate 1. The ejection orifice forming member 2 includes a plurality of through holes passing through a facing portion that faces a surface provided with the energy-generating element 5 in the substrate 1. The ejection orifice forming member 2 is formed of a resin material, and the plurality of through holes is formed collectively by using a photolithographic technique or an etching technique. Each of the through holes provided in the ejection orifice forming member 2 is formed of a first opening and a second opening that communicate with each other. The first opening is open in a position facing a surface provided with the energy-generating element 5 in the substrate 1, and the second opening is provided on a side where liquid is ejected. The through holes are used as ejection orifices 3 from which liquid supplied with energy generated by the energy-generating element 5 is ejected. The plurality of ejection orifices 3 is arranged in rows with a predetermined pitch, to form ejection orifice rows. It is noted that the through holes referred to here are through holes passing through the ejection orifice forming member 2, and are different from through holes serving as later-described recesses formed in the substrate 1.

As the energy-generating element 5 provided in the substrate 1, a heating element (heater) such as an electrothermal conversion element, a piezoelectric element (piezo element), or the like can be used. A plurality of energy-generating elements 5 is arranged in plural rows in positions facing the ejection orifice rows. Between adjacent ones of the rows of the energy-generating elements 5 (element rows), a recess that passes through the substrate 1 and supplies liquid to the energy-generating elements 5, that is, a supply path 6 forming a part of a flow path of liquid, is provided. It is noted that the recess referred to here includes a groove portion that is a long, narrow groove formed in the substrate 1, and also includes a through hole passing through the substrate 1.

The recess provided between the substrate 1 and the ejection orifice forming member 2 that is stacked on the substrate 1 forms a space located between the ejection orifice forming member 2 and the substrate 1. The space serves as a flow path through which liquid flows. A space that is formed in a position where the energy-generating element 5 is provided and contains the energy-generating element 5 is referred to as a pressure chamber 18 (refer to FIGS. 2A and 2B). A flow path leading to the pressure chamber 18 is referred to as an individual flow path 7. A flow path that extends from the supply path 6 and leads to the individual flow path 7 is referred to as a common liquid chamber 8. In a portion where the substrate 1 and the ejection orifice forming member 2 are in contact with each other, an adhesion improving resin layer 9 (refer to FIGS. 2A and 2B) is provided. In the substrate 1, a terminal (contact pad) 17 for supplying electric power to the energy-generating element 5 is provided. The terminal 17 of the substrate 1 is electrically connected to an external driving circuit or the like. Electric power is supplied to the energy-generating element 5 via the terminal 17, the energy-generating element 5 is activated to generate energy, and then liquid that has received the energy in the pressure chamber 18 is ejected to the outside from the ejection orifice 3.

[Reinforcing Rib and Configuration Therearound]

Figure 2A:
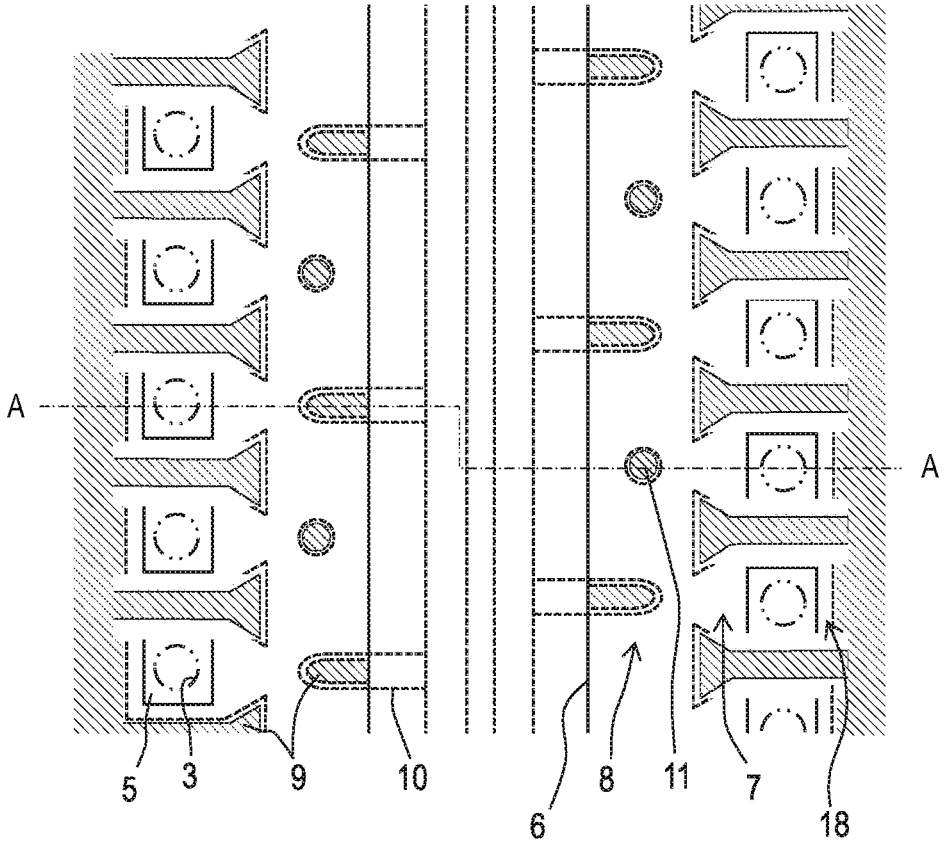
FIGS. 2A and 2B are views of a plane section and a cross section of the liquid ejection head illustrated in FIG. 1.
Figure 2B:
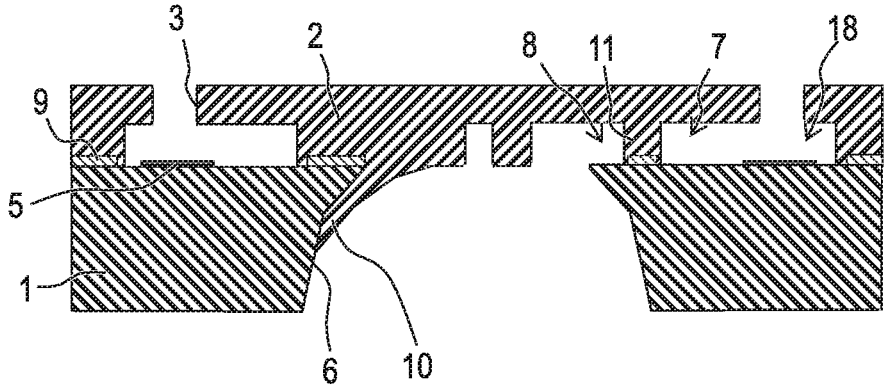

The reinforcing rib 10 that is employed in the liquid ejection head having the above-described configuration and is one of features of the present invention, together with a configuration around the reinforcing rib 10, will be described. FIG. 2A is a view of a plane section illustrating a part of the ejection orifice forming member 2 as if it is cut, in the liquid ejection head according to the present invention. In FIG. 2A, the adhesion improving resin layer 9 is represented by hatching, and a shape of the other part of the ejection orifice forming member 2 is represented by a broken line. FIG. 2B is a view of a cross section taken along a line A-A in FIG. 2A. In the liquid ejection head, an electric wiring layer (not illustrated) and the energy-generating element 5 are formed on a first surface of the substrate 1, and further, a wiring protection layer (not illustrated) having an insulative property and the adhesion improving resin layer 9 are placed thereon. In the substrate 1, the supply path 6 that is a recess (through hole) passing through the substrate 1 along a thickness direction is formed.

In the ejection orifice forming member 2, the ejection orifice 3 passing therethrough along a thickness direction is provided. In a surface of the ejection orifice forming member 2, the surface facing the substrate 1, recesses forming the individual flow path 7, the common liquid chamber 8, and the pressure chamber 18, respectively, are formed, and a columnar protrusion 11 being in contact with the first surface of the substrate 1 is formed. Also, the reinforcing rib 10 that protrudes further toward the substrate 1 than a bonding surface between the ejection orifice forming member 2 and the substrate 1 is formed.

The first surface of the substrate 1 and a surface of the ejection orifice forming member 2 on which the recess, the reinforcing rib 10, and the columnar protrusion 11 are formed are bonded to each other. Thus, the supply path 6 passing through the substrate 1 and the ejection orifice 3 passing through the ejection orifice forming member 2 communicate with each other via the common liquid chamber 8, the individual flow path 7, and the pressure chamber 18, to form a flow path of liquid. The columnar protrusion 11 formed integrally with the ejection orifice forming member 2 is located in the common liquid chamber 8 and an end thereof is fixed so as to be in contact with the substrate 1. Further, the reinforcing rib 10 formed integrally with the ejection orifice forming member 2 is disposed in the inside of the supply path 6 of the substrate 1. Specifically, the reinforcing rib 10 extends to the inside of the substrate 1 along a thickness direction, so that an end thereof is disposed in the inside of the supply path 6 over the first surface (bonding surface between the ejection orifice forming member 2 and the substrate 1) of the substrate 1. Then, the reinforcing rib 10 is fixed so as to be in contact with an inner surface of the supply path 6.

The reinforcing rib 10 formed in the above-described manner is fixed so as to be in contact with an inner surface of the supply path 6, and thus there is little likelihood that the reinforcing rib 10 peels off due to swelling caused by liquid in the ejection orifice forming member 2, or shear stress caused by shrinkage of an adhesive in a mounting step, for example. Also, while a planar area occupied by the reinforcing rib 10 on the substrate 1 may be nearly the same as that in the configuration of Japanese Patent Application Laid-Open No. 2007-283501, the reinforcing rib 10 in the present embodiment does not significantly block circulation of ink, so that ejecting characteristics are unlikely to be impaired. Considering that stress applied to the reinforcing rib 10 should be relieved in order to prevent peeling-off of the reinforcing rib 10, it is preferable that a plurality of reinforcing ribs 10 is arranged in rows parallel to the ejection orifice rows. It is particularly preferable that the plurality of reinforcing ribs 10 is placed so as to be arranged at regular intervals. It is preferable that a height of the reinforcing rib 10, that is, a depth to which the reinforcing rib 10 is disposed in the inside of the supply path 6, is 10 μm or less considering flatness of a bonding surface of the ejection orifice forming member 2. A depth to which the reinforcing rib 10 is disposed in the inside of the supply path 6 can be controlled by a condition for a process of providing a tape and a filler in the course of manufacture of the liquid ejection head 4. Detailed description in this respect will be given later.

[Method of Manufacturing a Liquid Ejection Head]

A specific method of manufacturing a liquid ejection head according to the present invention will be described.

First Embodiment

Figure 3A:
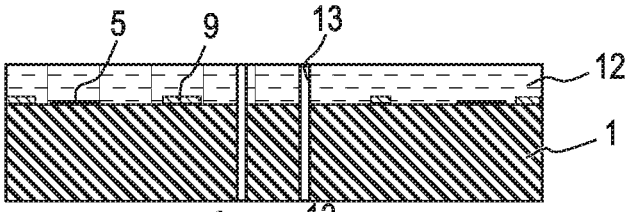
FIGS. 3A, 3B, 3C, 3D, 3E, 3F, 3G and 3H are views of cross sections illustrating in an order of steps, a method of manufacturing a liquid ejection head according to a first embodiment of the present invention.

FIGS. 3A to 3H are views of cross sections sequentially illustrating respective steps of a method of manufacturing a liquid ejection head according to a first embodiment. As illustrated in FIG. 3A, on the first surface of the substrate 1 made of silicon, that is, on a surface in which a crystal orientation of silicon is <100>, the energy-generating element 5 that is a heating element made of TaSiN, electric wiring (not illustrated) for a control signal for the energy-generating element 5, and the adhesion improving resin layer 9 are formed. Thereafter, an insulating layer made of SiN or the like is formed as a wiring protection layer by a formed film (not illustrated). Further, an alkali-resisting protection layer 12 is applied so that the wiring protection layer and the adhesion improving resin layer 9 are covered therewith. Then, by using a laser or the like, the through hole 13 is formed in a portion where the supply path 6 of the substrate 1 is to be formed. The adhesion improving resin layer 9 is a layer for improving adhesion between the substrate 1 and the ejection orifice forming member 2. The alkali-resisting protection layer 12 is made of cyclized rubber or the like, and is a layer for suppressing damages that are caused to a surface of the substrate 1 including the wiring protection layer, the adhesion improving resin layer 9, and the like, by a strong alkaline etchant used in a step of forming the supply path 6 or the like.

Figure 3B:
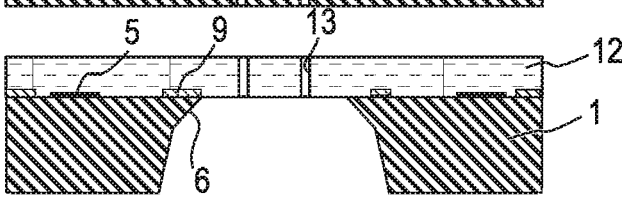
Figure 3C:
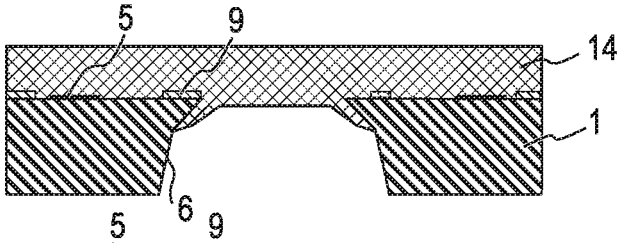

Subsequently, as illustrated in FIG. 3B, the supply path 6 is formed by anisotropic etching on both surfaces of the substrate 1. For the anisotropic etching, tetramethylammonium hydroxide (TMAH) is used as an etchant. Thereafter, the alkali-resisting protection layer 12 is removed. After the alkali-resisting protection layer 12 is removed, a tape 14 is affixed as illustrated in FIG. 3C. The tape 14 in the present embodiment has a bi-layer structure of a base material and a pressure-sensitive adhesive, and for example, a base material made of polyolefin and an acrylic UV-cure pressure-sensitive adhesive are used. However, a base material made of polyester, acryl, or the like, and a rubber-based thermosetting pressure-sensitive adhesive or the like may be used, for example. In one example, the tape 14 is affixed to the substrate 1 in an environment of a reduced pressure, and after that, the pressure is returned to an ordinary pressure. Due to the pressure at that time, the pressure-sensitive adhesive of the tape 14 is drawn into the inside of the supply path 6. Affixing the tape 14 in this manner produces a state where a part of the pressure-sensitive adhesive enters the inside of the supply path 6. A dimension of the tape 14 (a thickness of the pressure-sensitive adhesive and the like) and a condition (a pressure and the like) for an affixing step are set so as to allow a part of the tape 14 to enter the inside of the supply path 6 as described above. In other words, a depth to which the tape 14 enters the supply path 6 can be adjusted depending on a thickness of the pressure-sensitive adhesive or a pressure condition for an affixing step. Specifically, when the tape 14 including a pressure-sensitive adhesive having a thickness of approximately 50 μm is affixed to the substrate 1 in an environment of a reduced pressure of approximately 100 Pa and subsequently the pressure is returned to an ordinary pressure, there can be produced a state where a part of the tape 14 enters the inside of the supply path 6 by approximately 5 μm from the first surface of the substrate 1. However, as long as the tape 14 can be affixed so that a part thereof enters the supply path 6, not the method using an environment of a reduced pressure, but a method in which the tape 14 is pressurized by a roller or the like, to be affixed to the substrate 1, may be employed.

Figure 3D:
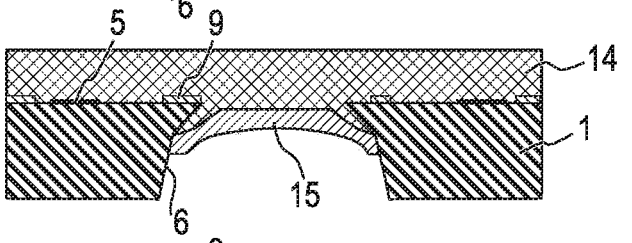
Figure 3E:
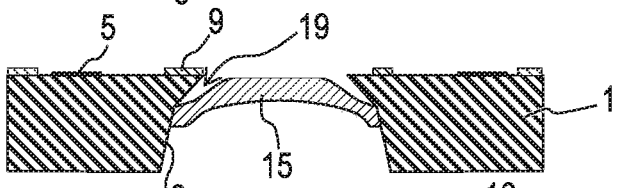

Subsequently, as illustrated in FIG. 3D, a filler 15 is applied from a second surface (a surface opposite to the first surface) side of the substrate 1. For this step, the tape 14 is used as a stop layer for the filler 15. The filler 15 is charged in the supply path 6 along the tape 14 with no clearance being left. For the filler 15, a polyvinyl alcohol aqueous solution in which a concentration of solid contents is 30 wt % is used, and application of the solution is performed so that a film thickness to be provided after baking is approximately 20 μm, to form the filler 15. Then, as illustrated in FIG. 3E, the tape 14 is peeled off. As the tape 14 is affixed so that a part thereof enters the supply path 6 as illustrated in FIGS. 3C and 3D, a clearance 19 is produced between the filler 15 and an inner surface of the supply path 6 as illustrated in FIG. 3E after the tape 14 is peeled off.

Figure 3F:
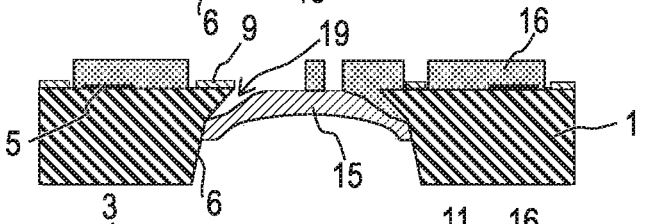

A positive photosensitive resin is applied onto the substrate 1 by a spin-coating process or the like, so that a mold material 16 having a thickness of 15 μm is formed. Thereafter, as illustrated in FIG. 3F, the mold material 16 is patterned by a photolithographic process. At that time, the patterning is performed so that a part of the mold material 16 located in a portion where the reinforcing rib 10 is to be formed is removed while a part of the mold material 16 forming the common liquid chamber 8 remains.

Figure 3G:
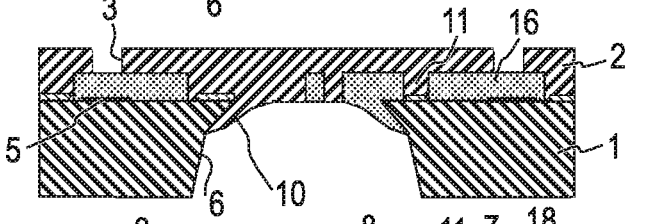
Figure 3H:
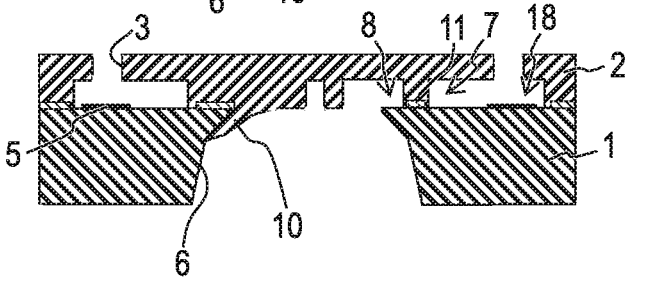

Subsequently, as illustrated in FIG. 3G, a negative photosensitive resin layer is applied onto the patterned mold material 16 by a spin-coating process or the like, so that the ejection orifice forming member 2 having a thickness of 20 μm is formed. At that time, the negative photosensitive resin layer (a material forming the ejection orifice forming member 2) is applied also to the clearance 19 extending over a range from the first surface of the substrate 1 to a depth of approximately 5 μm, between the filler 15 and an inner surface of the supply path 6 of the substrate 1. This portion serves as the reinforcing rib 10. That is, formation of the ejection orifice forming member 2 in an area including a position where the tape 14 of the substrate 1 has been peeled off achieves formation of the reinforcing rib 10 in the clearance 19 between the filler 15 and an inner surface of the supply path 6 of the substrate 1. Then, the ejection orifice forming member 2 is patterned by a photolithographic process, so that the ejection orifice 3 is formed. Further, the filler 15 is removed. Lastly, as illustrated in FIG. 3H, the mold material 16 is removed, so that the pressure chamber 18, the individual flow path 7, the common liquid chamber 8, and the columnar protrusion 11 are formed. Thereafter, those are heated at a temperature of 200° C., to achieve thermosetting.

By the above-described steps, a wafer in which a plurality of liquid ejection mechanisms is formed in a single substrate 1 is manufactured. The substrate 1 in this wafer is cut by dicing, so that a plurality of chips is obtained. The cut chips are connected to a chip plate (not illustrated) for liquid supply, and thus the liquid ejection head 4 is formed. In this manner, the liquid ejection head 4 according to the present invention is completed.

Additionally, to control the reinforcing rib 10 so that the reinforcing rib 10 is disposed in the supply path 6 to a desirable depth from the first surface of the substrate 1, it is preferable that a thickness of the pressure-sensitive adhesive of the tape 14 is 10 μm or more and 50 μm or less. Then, it is preferable that the step of affixing the tape 14 is performed in an environment of a reduced pressure of a low vacuum or a medium vacuum that is 50 Pa or higher and 200 Pa or lower. For the filler 15, while polyvinyl alcohol, wax, cyclized rubber, and the like can be used, a material that is hard to dissolve in an organic solvent used in a later step and can be easily removed with water or hot water is preferable. The filler 15 is formed by being applied and dried by dispensing or screen printing. It is preferable that a depth to which the supply path 6 is filled with the filler 15 is 10 μm or more, in terms of strength.

The reinforcing rib 10 of the liquid ejection head 4 according to the present invention is formed integrally with the ejection orifice forming member 2, and is adhered and fixed to an inner surface of the supply path 6 of the substrate 1. Accordingly, the reinforcing rib 10 does not easily peel off and improves bonding strength between the substrate 1 and the ejection orifice forming member 2. Further, as the reinforcing rib 10 is not located midway in flow of liquid, but is adhered to an inner surface of the supply path 6, the reinforcing rib 10 neither becomes a cause of flow resistance nor blocks flow of liquid.

Second Embodiment

A method of manufacturing a liquid ejection head according to a second embodiment of the present invention will be described with reference to FIGS. 4A to 4H. Components similar to those in the first embodiment will be denoted by the same reference signs and description thereof will be omitted. Description in different respects will be given chiefly.

Figure 4A:
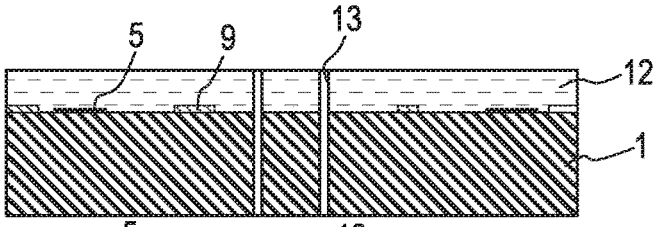
FIGS. 4A, 4B, 4C, 4D, 4E, 4F, 4G and 4H are views of cross sections illustrating in an order of steps, a method of manufacturing a liquid ejection head according to a second embodiment of the present invention.
Figure 4B:
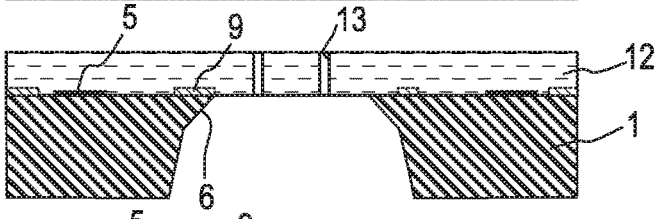
Figure 4C:
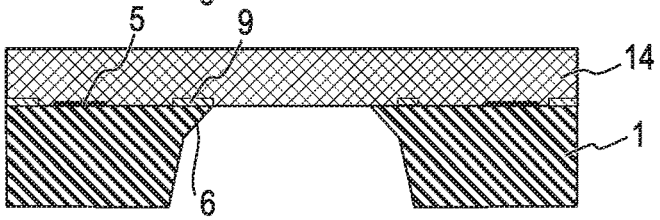
Figure 4D:
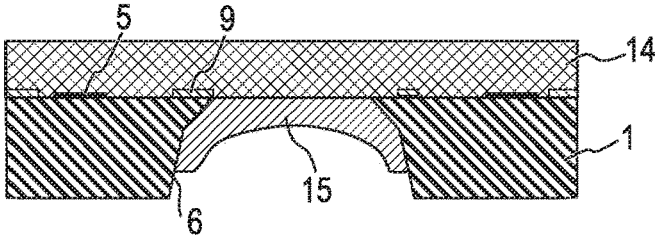
Figure 4E:
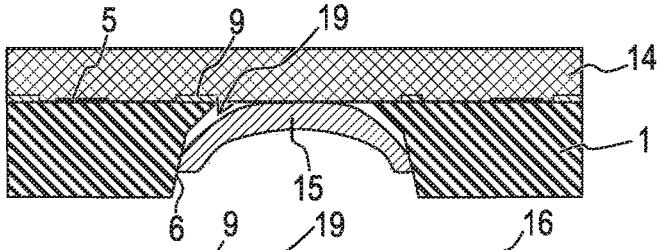
Figure 4F:
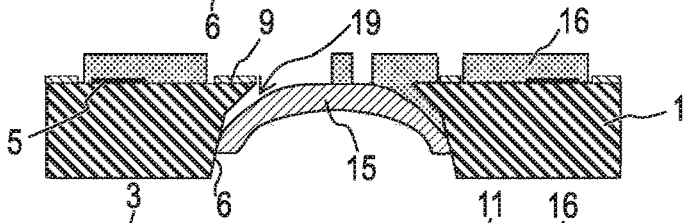
Figure 4G:
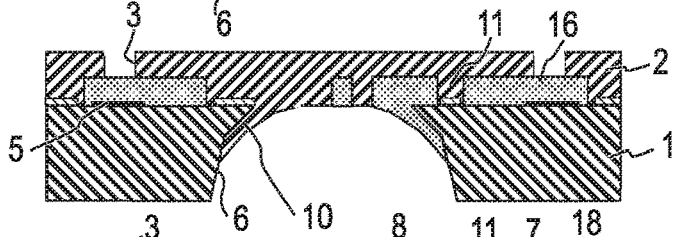
Figure 4H:
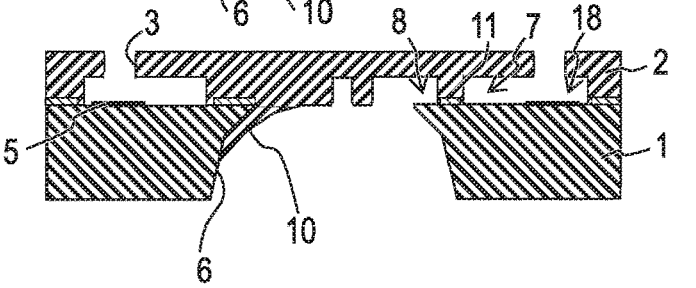

In the first embodiment, a tape 14 is affixed so that a part thereof enters a supply path 6, and thus a reinforcing rib 10 is formed so as to be disposed in the inside of the supply path 6. In contrast thereto, in the present embodiment, after an alkali-resisting protection layer 12 is applied to a first surface of a substrate 1 and the supply path 6 is formed in the same manner as in the first embodiment as illustrated in FIGS. 4A and 4B, the tape 14 is affixed to the first surface of the substrate 1 in parallel with the first surface as illustrated in FIG. 4C. Then, as illustrated in FIG. 4D, a filler 15 is applied to a position contacting with the tape 14, from a second surface (a surface opposite to the first surface) side of the substrate 1. In other words, as viewed from the first surface of the substrate 1, the filler 15 is charged in a shallow position in the supply path 6. A concentration of solid contents in the filler 15 is 20 wt %, and the filler 15 is formed so that a thickness to be provided after baking is approximately 50 μm. Subsequently, as illustrated in FIG. 4E, heating at a temperature of 60° C. is performed for five minutes, to bake the filler 15. Heat shrinkage occurs during baking because a water content of the filler 15 is higher than that in the first embodiment and a thickness of the filler 15 is larger. As a result, a clearance 19 is produced, extending over a range from the first surface of the substrate to a depth of approximately 5 μm, between the filler 15 and an inner surface of the supply path 6. Thereafter, as illustrated in FIGS. 4F to 4H, an ejection orifice forming member 2 is formed in the same manner as in the first embodiment and a part thereof is caused to be disposed in the clearance 19 between the filler 15 and an inner surface of the supply path 6, so that the reinforcing rib 10 is formed. Then, the ejection orifice 3, the individual flow path 7, the common liquid chamber 8, the columnar protrusion 11, and the pressure chamber 18 are formed by using a photolithographic process or the like, and are heated at a temperature of 200° C., to achieve thermosetting. Also, in the present embodiment, forming the reinforcing rib 10 so as to be adhered to an inner surface of the supply path 6 of the substrate 1 reduces a likelihood of peeling-off and improves bonding strength between the substrate 1 and the ejection orifice forming member 2. Further, the reinforcing rib 10 neither becomes a cause of flow resistance nor blocks flow of liquid. Additionally, in the present embodiment, by adjustment of a concentration of solid contents, an applied amount, and a baking temperature of the filler 15, the clearance 19 between the filler 15 and an inner surface of the supply path 6 can be adjusted, so that the reinforcing rib 10 having a desired size can be formed.

Though the reinforcing rib 10 is formed so as to be disposed in the inside of the supply path 6 in the above description, the reinforcing rib 10 can be formed so as to be disposed in the inside of other recesses (for example, the common liquid chamber) provided in the substrate 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-023546, filed Feb. 13, 2019, which is hereby incorporated by reference herein in its entirety.

What is claimed is:

1. A liquid ejection head comprising:

a substrate provided with an energy-generating element;

an ejection orifice forming member that is stacked on the substrate and includes an ejection orifice from which liquid is ejected;

a reinforcing rib provided in the ejection orifice forming member; and a recess that is formed in the substrate and forms a part of a flow path of the liquid, wherein in viewing a cross-section of the liquid ejection head, the recess has two inner surfaces, and the reinforcing rib is fixed to only one inner surface of the two inner surfaces of the recess.

2. The liquid ejection head according to claim 1, wherein the recess is a supply path passing through the substrate along a thickness direction.

3. The liquid ejection head according to claim 2, wherein the supply path communicates with the ejection orifice via a common liquid chamber, an individual flow path, and a pressure chamber that are formed between the substrate and the ejection orifice forming member.

4. The liquid ejection head according to claim 1, wherein part of the reinforcing rib is disposed in the inside of the recess from a bonding surface between the substrate and the ejection orifice forming member to a depth of greater than 0 μm and is 10 μm or less.

5. The liquid ejection head according to claim 1, wherein the reinforcing rib is provided plural in number and the plurality of the reinforcing ribs is placed so as to be arranged at regular intervals.

6. The liquid ejection head according to claim 1, wherein a resin layer is provided between the substrate and the ejection orifice forming member.

7. The liquid ejection head according to claim 1, wherein the reinforcing rib extends toward a direction orthogonally intersecting an array direction of the ejection orifice.

8. The liquid ejection head according to claim 1, wherein the reinforcing rib is provided plural in number and includes a first reinforcing rib extending in a first direction and a second reinforcing rib extending in a second direction, the second direction being opposite to the first direction.

9. The liquid ejection head according to claim 8, wherein the first reinforcing rib and the second reinforcing rib are disposed alternately in a longitudinal direction of the substrate.

10. A method of manufacturing a liquid ejection head, comprising:

forming a through-hole passing through a substrate, in the substrate;

affixing a tape to the substrate in which the through-hole is formed;

applying a filler in a position contacting with the tape in an inside of the through-hole;

peeling off the tape after applying the filler;

forming an ejection orifice forming member in an area including at least a part of a position where the tape has been peeled off the substrate; and forming an ejection orifice passing through the ejection orifice forming member, in the ejection orifice forming member, wherein in the affixing of the tape, a part of the tape is caused to enter the inside of the through-hole, in the peeling-off of the tape, a clearance is produced between the filler and an inner surface of the through-hole, and in the forming of the ejection orifice forming member, a part of a material forming the ejection orifice forming member is caused to enter an inside of the clearance, to form a reinforcing rib from the material entering the inside of the clearance such that in viewing a cross-section of the liquid ejection head, the through-hole has two inner surfaces, and the reinforcing rib is fixed to only one inner surface of the two inner surfaces of the through-hole.

11. The method of manufacturing a liquid ejection head according to claim 10, wherein, in the affixing of the tape, after the tape is affixed in an environment of a reduced pressure, the pressure is returned to an ordinary pressure, to draw the part of the tape into the inside of the through-hole.

12. The method of manufacturing a liquid ejection head according to claim 10, wherein the reinforcing rib is formed so as to be disposed in the inside of the through-hole to a depth that is greater than 0 μm and is 10 μm or less from a bonding surface between the substrate and the ejection orifice forming member.

13. The method of manufacturing a liquid ejection head according to claim 10, wherein the reinforcing rib is provided plural in number and the plurality of the reinforcing ribs is formed so as to be arranged at regular intervals.

14. The method of manufacturing a liquid ejection head according to claim 10, wherein the through-hole is a supply path forming a part of a flow path of liquid.

15. The method of manufacturing a liquid ejection head according to claim 14, wherein a common liquid chamber, an individual flow path, and a pressure chamber are formed between the substrate and the ejection orifice forming member, to cause the supply path and the ejection orifice to communicate with each other.

16. A method of manufacturing a liquid ejection head, comprising:

forming a through-hole passing through a substrate, in the substrate;

affixing a tape to the substrate in which the through-hole is formed;

applying a filler in a position contacting with the tape in an inside of the through-hole;

peeling off the tape after applying the filler;

forming an ejection orifice forming member in an area including at least a part of a position where the tape has been peeled off the substrate; and forming an ejection orifice passing through the ejection orifice forming member, in the ejection orifice forming member, wherein the applied filler is shrunk, to produce a clearance between the filler and an inner surface of the through-hole, in the forming of the ejection orifice forming member, a part of a material forming the ejection orifice forming member is caused to enter an inside of the clearance, and a reinforcing rib is formed from the material entering the inside of the clearance such that in viewing a cross-section of the liquid ejection head, the through-hole has two inner surfaces, and the reinforcing rib is fixed to only one inner surface of the two inner surfaces of the through-hole.

* * * * *